US009670721B2

(12) United States Patent
Guhl

(10) Patent No.: US 9,670,721 B2
(45) Date of Patent: Jun. 6, 2017

(54) GUIDE ARRANGEMENT FOR HANGINGS

(71) Applicant: Beat Guhl, Ottoberg (CH)

(72) Inventor: Beat Guhl, Ottoberg (CH)

( * ) Notice: Subject to any disclaimer, the term of this patent is extended or adjusted under 35 U.S.C. 154(b) by 16 days.

(21) Appl. No.: 14/440,151

(22) PCT Filed: Oct. 18, 2013

(86) PCT No.: PCT/CH2013/000179

§ 371 (c)(1),
(2) Date: May 1, 2015

(87) PCT Pub. No.: WO2014/071534

PCT Pub. Date: May 15, 2014

(65) Prior Publication Data

US 2015/0275571 A1 Oct. 1, 2015

(30) Foreign Application Priority Data

Nov. 9, 2012 (CH) ..... 2302/12
Oct. 10, 2013 (CH) ..... 1729/13

(51) Int. Cl.
*E06B 9/30* (2006.01)
*E06B 9/322* (2006.01)
(Continued)

(52) U.S. Cl.
CPC ..... *E06B 9/322* (2013.01); *E06B 9/327* (2013.01); *E06B 9/58* (2013.01);
(Continued)

(58) Field of Classification Search
CPC ..... E06B 2009/583; E06B 9/327
(Continued)

(56) References Cited

U.S. PATENT DOCUMENTS 1,289,281 A * 12/1918 Shaft ..... E06B 9/262 160/84.06
1,702,664 A * 2/1929 Muller ..... E04F 10/02 160/172 R
(Continued)

FOREIGN PATENT DOCUMENTS

DE 19632973 A1 2/1998
DE 19852522 A1 6/1999
(Continued)

OTHER PUBLICATIONS

Search report ("Recherchenbericht") to Swiss patent application CH02302/12 as completed on Dec. 12, 2012 and annexed to patent application publication CH 707 169 A1.
(Continued)

*Primary Examiner* — Katherine Mitchell
*Assistant Examiner* — Johnnie A Shablack
(74) *Attorney, Agent, or Firm* — David P. Dickerson

(57) ABSTRACT

On large window and door openings frequently made today, the manufacturers of venetian blinds in particular cannot cover the whole opening with just one blind. Therefore, it is necessary to arrange two or more hangings. However, these must be guided on both sides, and therefore a lateral guide between the two jambs of the opening is necessary. Such a guide is, however, undesirable for aesthetic reasons. According to the invention a temporary guide is created for the edges which need not be guided in the jambs and does this by means of a guide arrangement which can be accommodated rolled-up above the elevating device and can be introduced into the door or window opening.

19 Claims, 9 Drawing Sheets

Figure 5:
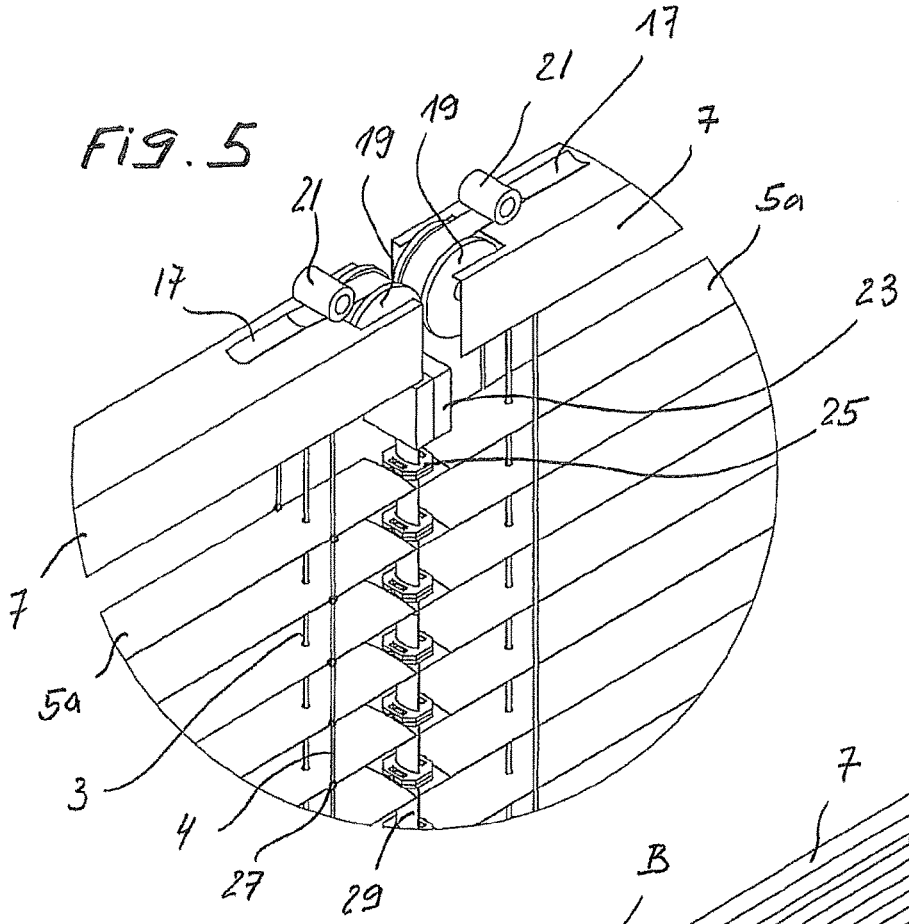

(51) Int. Cl.
*E06B 9/327* (2006.01)
*E06B 9/58* (2006.01)

(52) U.S. Cl.
CPC ... *E06B 2009/583* (2013.01); *E06B 2009/587* (2013.01); *Y10T 29/49826* (2015.01)

(58) Field of Classification Search
USPC ..... 160/169, 84.06, 172 R, 173 R, 177 R, 160/178.1 R
See application file for complete search history.

(56) References Cited

U.S. PATENT DOCUMENTS 1,787,158 A * 12/1930 McNulty ..... E06B 9/327 160/172 R
1,954,464 A * 4/1934 Violette ..... E06B 9/0638 160/172 R
2,152,068 A * 3/1939 Lawson ..... E06B 9/325 160/349.1
2,523,003 A * 9/1950 Donop ..... E06B 9/308 160/170
2,535,751 A * 12/1950 Nardulli ..... E06B 9/308 160/170
2,574,609 A * 11/1951 Appelbaum ..... E06B 9/388 160/178.1 R
2,794,501 A * 6/1957 Samuelsson ..... B60J 1/2088 160/169
3,721,285 A * 3/1973 Debs ..... E06B 9/327 160/172 R
3,818,969 A * 6/1974 Debs ..... E06B 9/327 160/168.1 R
4,607,816 A * 8/1986 Haines ..... B60J 1/2088 16/382
4,733,711 A * 3/1988 Schon ..... E06B 9/262 160/279
4,753,281 A * 6/1988 Wagner ..... E06B 9/262 160/279
4,776,381 A * 10/1988 Riddiford ..... E06B 9/327 160/172 R
4,865,108 A * 9/1989 Hennequin ..... E06B 9/32 160/172 R
5,052,460 A * 10/1991 Buckingham ..... E06B 9/325 160/178.1 R
5,083,598 A * 1/1992 Schon ..... E06B 9/32 160/279
5,373,916 A * 12/1994 Kiviniemi ..... B66B 13/143 160/84.06
5,460,215 A * 10/1995 Schon ..... E06B 9/262 160/178.1 R
5,533,559 A * 7/1996 Judkins ..... E06B 9/327 160/172 R
5,771,952 A * 6/1998 Gabriel ..... E06B 9/326 160/107
5,918,656 A * 7/1999 Daniels ..... E06B 9/307 160/168.1 R
6,273,173 B1 * 8/2001 Lassen ..... E06B 9/42 160/265
6,283,191 B1 * 9/2001 Lo ..... E06B 9/262 160/265
6,338,378 B1 * 1/2002 Kold ..... E06B 9/327 160/279
6,681,831 B1 * 1/2004 Cheng ..... E06B 9/262 160/170
6,796,360 B2 * 9/2004 Ferrie ..... E06B 9/327 160/172 R
7,114,545 B2 * 10/2006 Null ..... E06B 9/266 160/173 R
7,117,918 B2 * 10/2006 Franssen ..... E06B 9/327 160/172 R
7,191,817 B2 * 3/2007 Nicolosi ..... E06B 9/264 160/107
7,841,376 B2 * 11/2010 Lin ..... E06B 9/32 160/168.1 R
7,971,625 B2 * 7/2011 Garmyn ..... E06B 9/327 160/277
8,353,325 B2 * 1/2013 Chen ..... H05K 13/00 160/84.03
8,567,474 B2 * 10/2013 Lin ..... E06B 9/32 160/178.1 R
8,708,023 B2 * 4/2014 Wu ..... E06B 9/322 160/170
9,382,756 B2 * 7/2016 Cheringal ..... E06B 9/38
2004/0250963 A1 * 12/2004 Hsu ..... E06B 9/302 160/84.03
2005/0082018 A1 * 4/2005 Nien ..... E06B 9/327 160/172 R
2009/0277592 A1 * 11/2009 Okachi ..... E06B 9/262 160/84.06
2013/0008616 A1 * 1/2013 Huang ..... E06B 9/32 160/84.01
2015/0275571 A1 * 10/2015 Guhl ..... E06B 9/327 160/172 R

FOREIGN PATENT DOCUMENTS

DE 102009004354 A1 * 7/2010 ..... E06B 9/32
DE EP 2216485 A2 * 8/2010 ..... E06B 9/262
DE 102010020410 A1 11/2011
DE EP 2439375 A2 * 4/2012 ..... E06B 9/262
DE 202012100650 * 5/2013 ..... E06B 9/262
DE 102011087443 A1 * 6/2013 ..... E06B 9/262
DE EP 1681435 B1 * 6/2013 ..... E06B 9/32
DE 202013103831 U1 * 2/2014 ..... E06B 9/262
DE 202013101591 U1 * 7/2014 ..... E06B 9/266
EP 0753642 A2 1/1997
EP 1640554 A1 3/2006
EP 1681435 A2 7/2006
EP 1783320 A1 5/2007
EP 2039960 A2 3/2009
EP 2386781 A1 11/2011
FR 2978483 A1 * 2/2013 ..... E06B 9/327
GB 2464824 B * 5/2013 ..... E06B 9/323
IT EP 2177707 A1 * 4/2010 ..... E06B 9/42
JP 51134954 U 10/1976
JP 021396 U 1/1990
NL WO 9316265 A1 * 8/1993 ..... E06B 9/262
NL EP 2216484 A1 * 8/2010 ..... E06B 9/32
NL EP 2578792 A1 * 4/2013 ..... E06B 9/266
PL DE 202014003907 U1 * 7/2014 ..... E06B 9/262

OTHER PUBLICATIONS

International Search Report (ISR) with regard to PCT/CH2013/000179 as completed by the EPO on Dec. 5, 2013 and mailed on Dec. 12, 2013.

* cited by examiner

Fig. 1
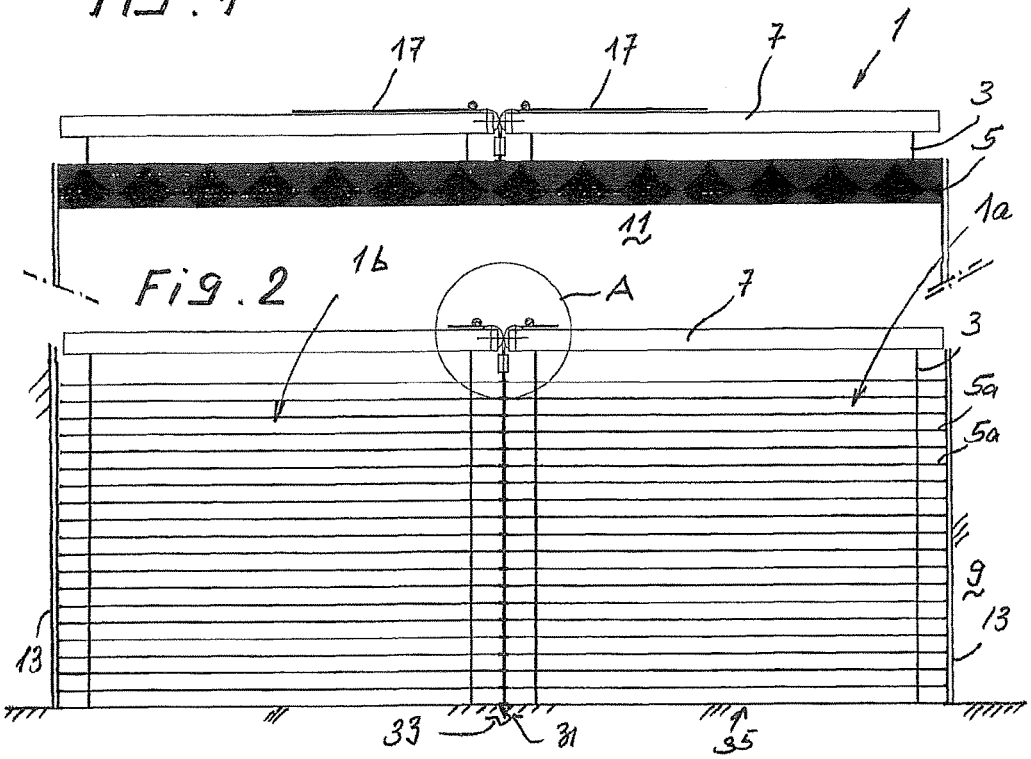
Fig. 2
Fig. 3
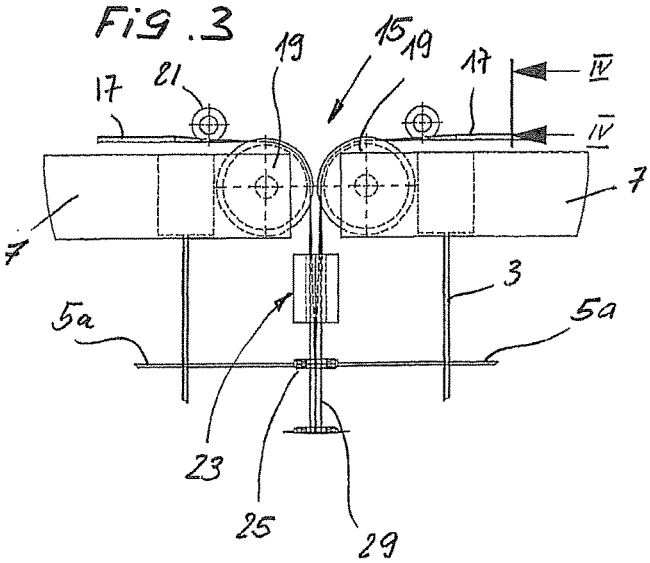
Fig. 4
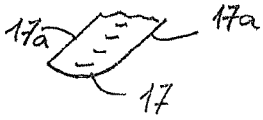

Fig. 15
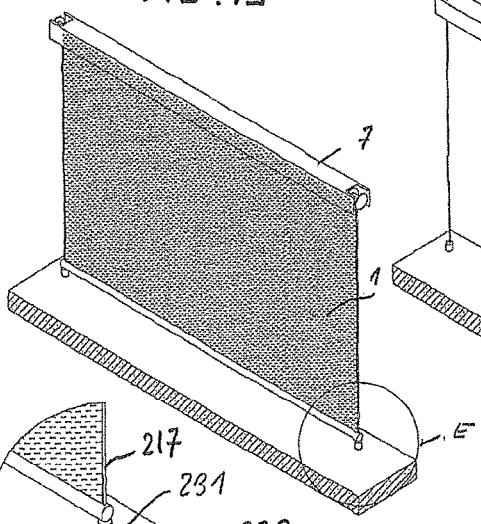
Fig. 17
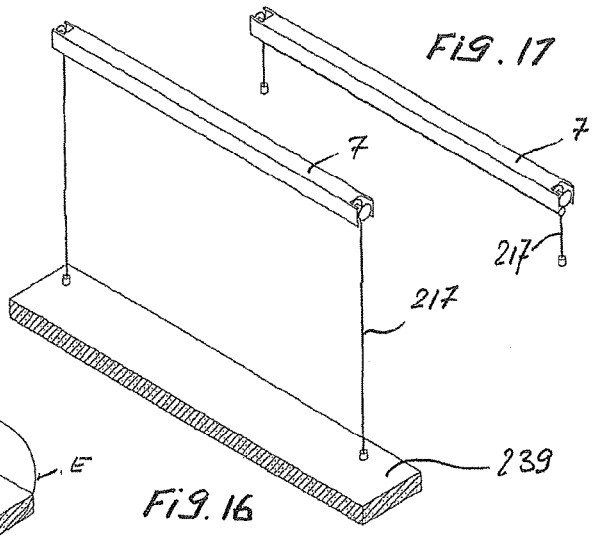
Fig. 16
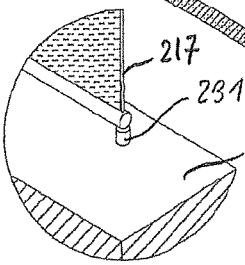
Fig. 18
Fig. 19
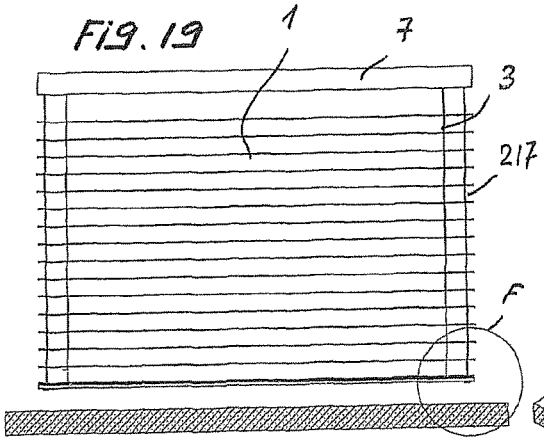
Fig. 21
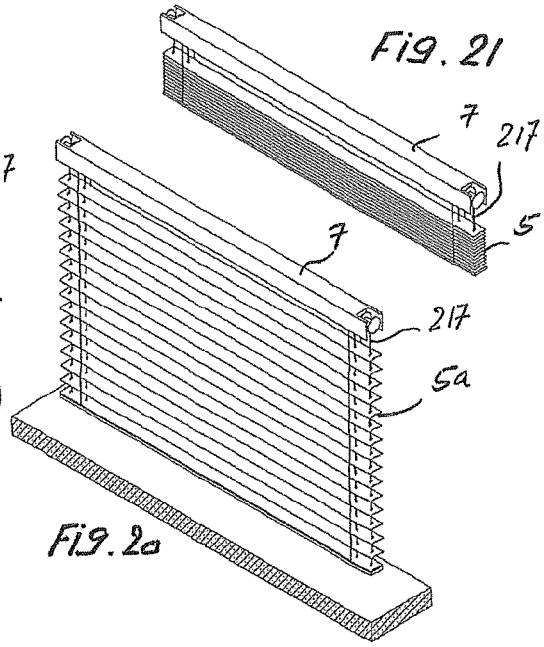
Fig. 20
Fig. 22
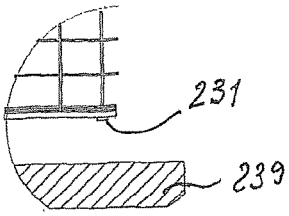

GUIDE ARRANGEMENT FOR HANGINGS

The subject matter of the invention is a guide arrangement for hangings such as a blind or sunblind, in accordance with the preamble of claim 1.

Guide arrangements are used to vertically and laterally guide hangings, in particular venetian blinds and sunblinds. The guide rails provide the hanging with a lateral guide and a definite stop and prevent the hanging moving horizontally in the event of gusts of wind. Each hanging is usually guided by two guide rails which are laterally attached to the jambs of windows or doors of the building.

For some years now door and window openings have been made larger and larger, often being constructed as giant sliding windows. The result of this is, therefore, openings which are several meters wide and which exceed the maximum hanging widths which can be supplied by blind manufacturers. However, in order to also be able to mount a venetian blind or a vertical sunblind in front of such large openings, it is necessary to install one or more columns with guide rails arranged thereon in the clear cross-section of the opening between the two lateral jambs of the windows. This is undesirable for aesthetic reasons, because the unobstructed line of vision which is guaranteed by modern sliding windows is adversely affected by guide rail columns.

It is also known that, in the case of fixed glazing, the slats are supported and guided in the center by a wire which is fixed at the top and bottom.

One object of this invention is to now create a temporary guide arrangement, in order to guide two hangings respectively which are located next to each other and which are guided on one side on fixed guides, on the second side in the lowered condition and, when the hangings are pulled up, to make the second temporary guide disappear again from the field of vision, i.e. from the clear opening of the window or the door.

This object is achieved by a guide arrangement according to the features of claim 1. Advantageous embodiments of the guide arrangement are described in the dependent claims.

With the aid of elongated bodies forming a linear guide, which are either introduced vertically downwards from above into the door or window opening or which, on the one hand, can be deflected about a deflection pulley and, on the other hand, are rigid in the extended or tensed position, a guide can be produced before or during the lowering of the hanging and can also be removed again from the field of vision when the hanging is pulled up.

By using two link chains which are arranged, for example, lying above the elevating device and are deflected downwardly in order to form a temporary guide and are hooked to each other during the deflection, a stable, in particular a rigid guide can be created. In a preferred embodiment the front, that is the lower end, of the two combined link chains is connected to a holding and catching device arranged at the bottom of the door or window opening, said holding and catching device preventing the rigid guide rail swinging away laterally in the bottom area if, depending on the wind conditions, greater forces impinge on the lowered hanging. In the case of strong gusts of winds the new temporary guide is lowered and formed before the hanging is lowered, so that only the guide is exposed to any wind forces.

In a further advantageous embodiment of the invention, instead of a link chain, a steel strip is provided which substantially has an arc-shaped cross-section at rest, which is also stored above the elevating device and, on being guided down, combines with a second strip which is arranged as a mirror image and has a high degree of stiffness due to the tubular hollow body thus formed. The two strips are held securely in each position by guide sliders which are fastened to the ends of the two adjacent edges of the hangings.

In a further inexpensive embodiment, a wire rope or a strip is guided vertically downwards prior to the lowering or, if there is no wind, together with the lowering of the hanging, and the lower end thereof is suspended from a suitable holding and tensioning device, for example a slot or an eyelet. By gently pulling back, i.e. pulling the rope upwards, the latter can be tensioned and therefore also forms a temporary guide in the center of the window or door opening. The tensioning can of course also be effected by moving the holding and tensioning device downwards. In the case of door openings of a width which requires more than two hangings, the centrally arranged hangings can be respectively guided on both sides by temporary guides according to the invention.

Figure 6:
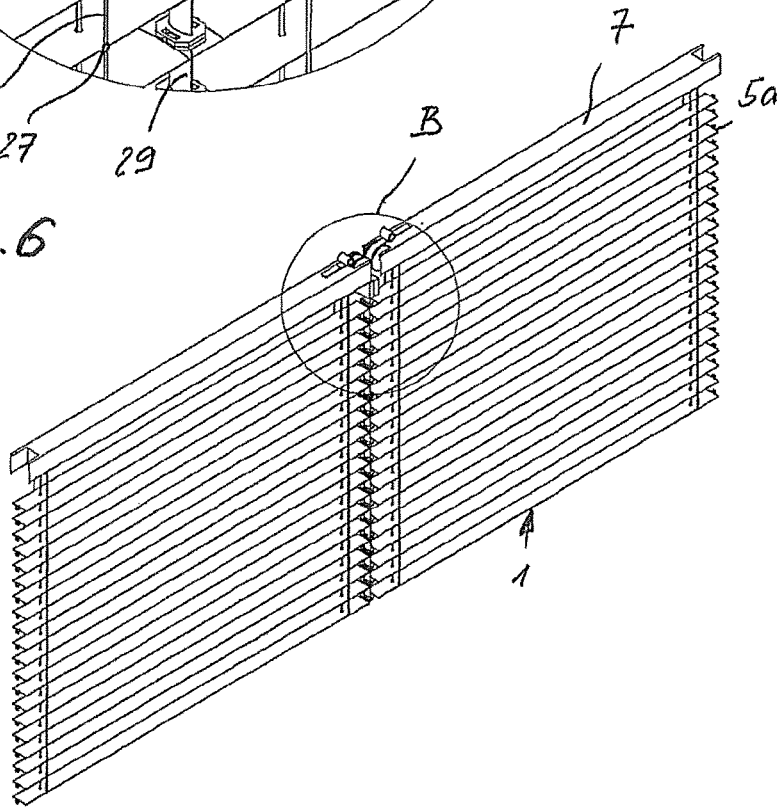
Figure 7:
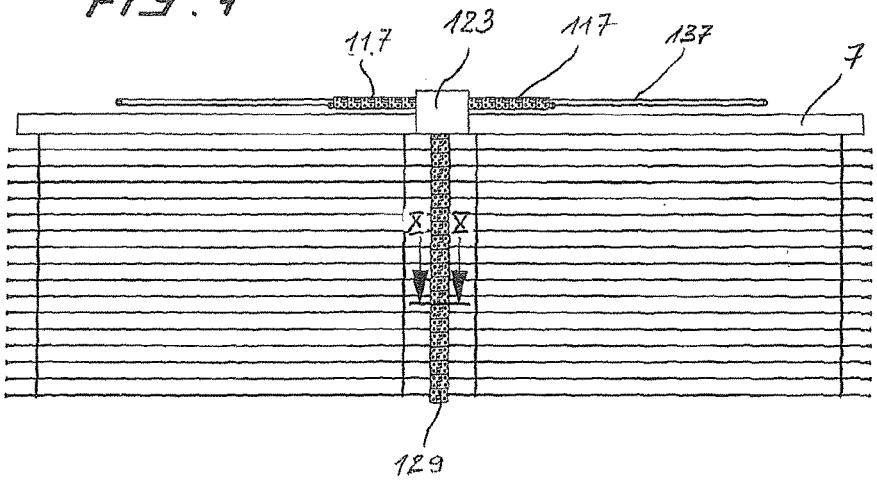
Figure 9:
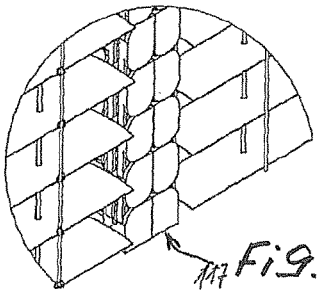
Figure 10:
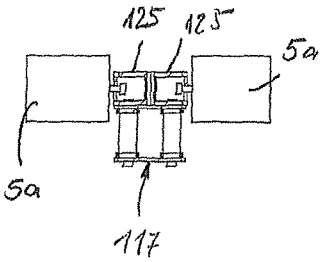
Figure 8:
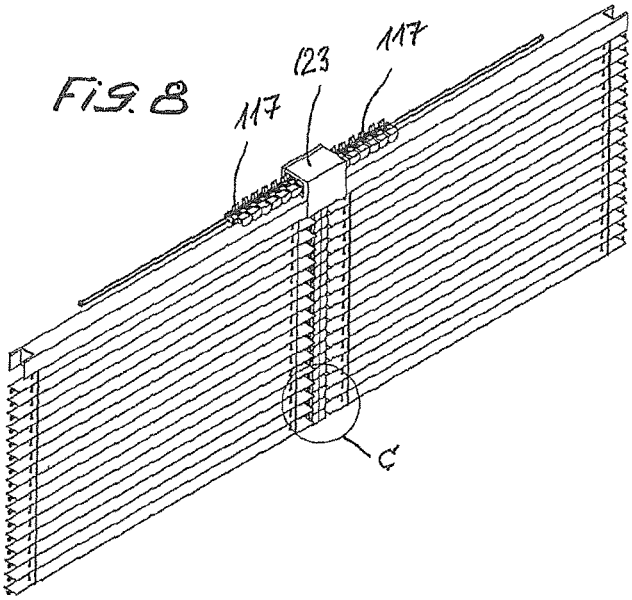
Figure 11:
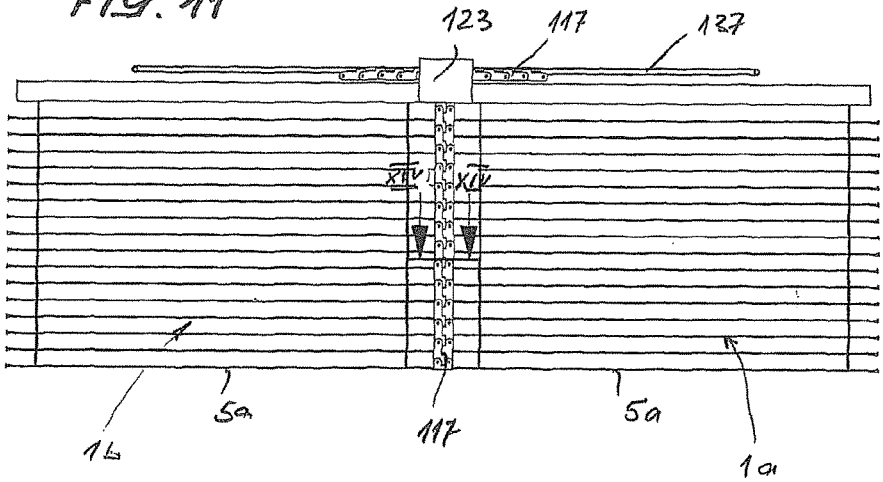
Figure 13:
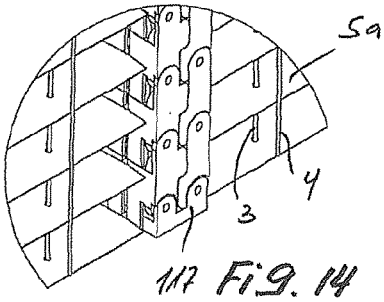
Figure 14:
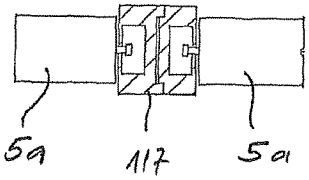
Figure 12:
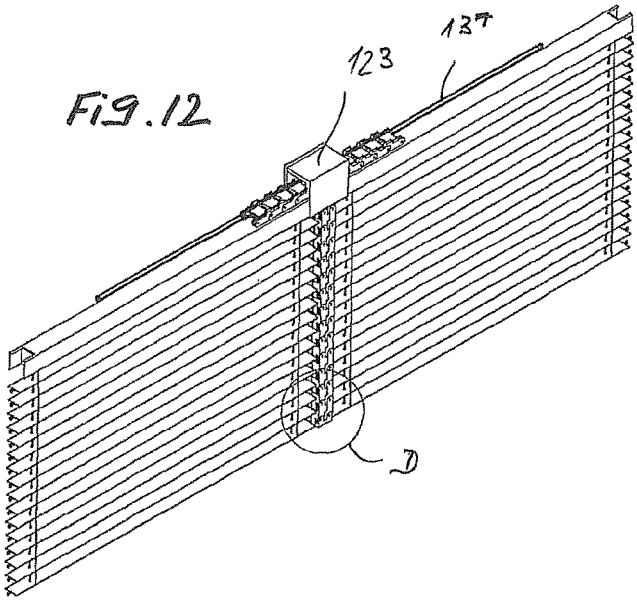
Figure 23:
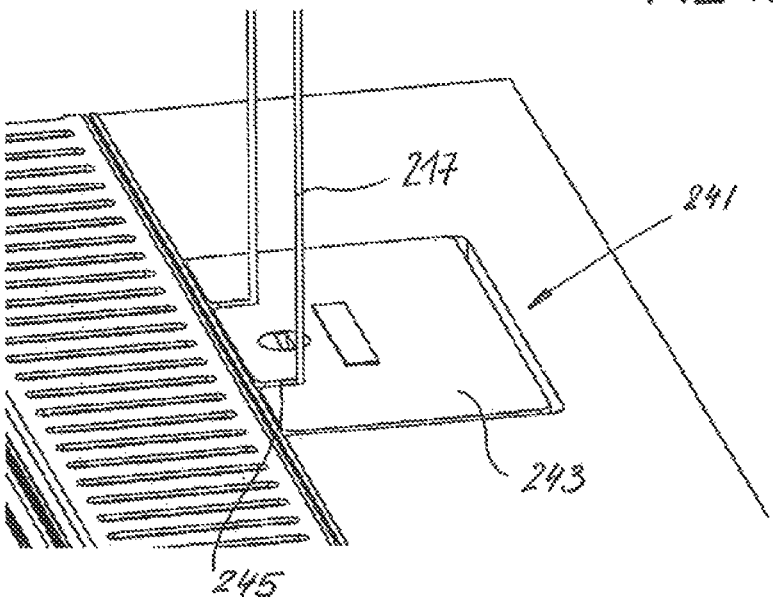
Figure 24:
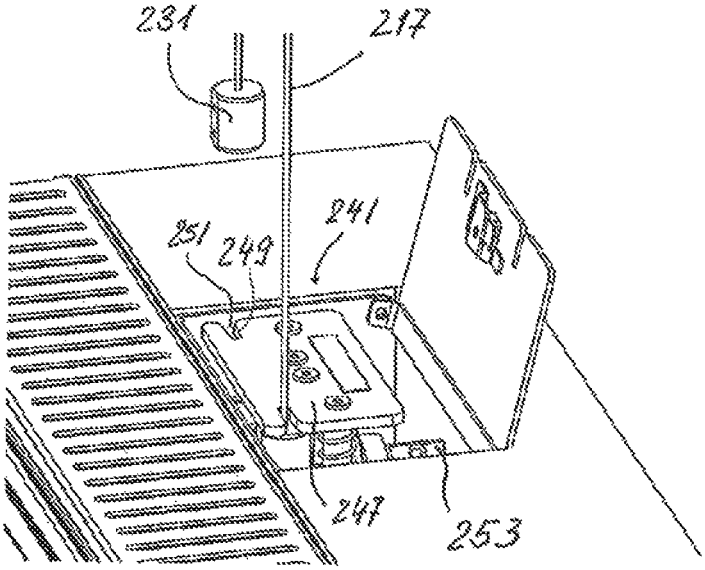
Figure 27:
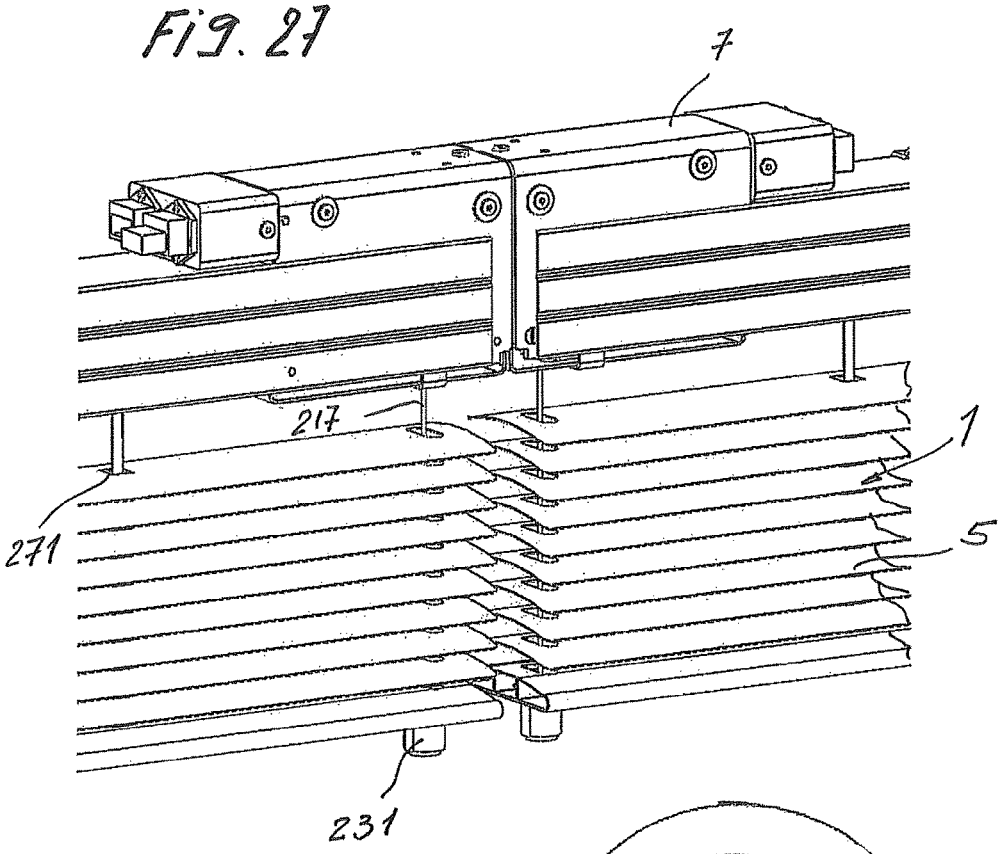
Figure 25:
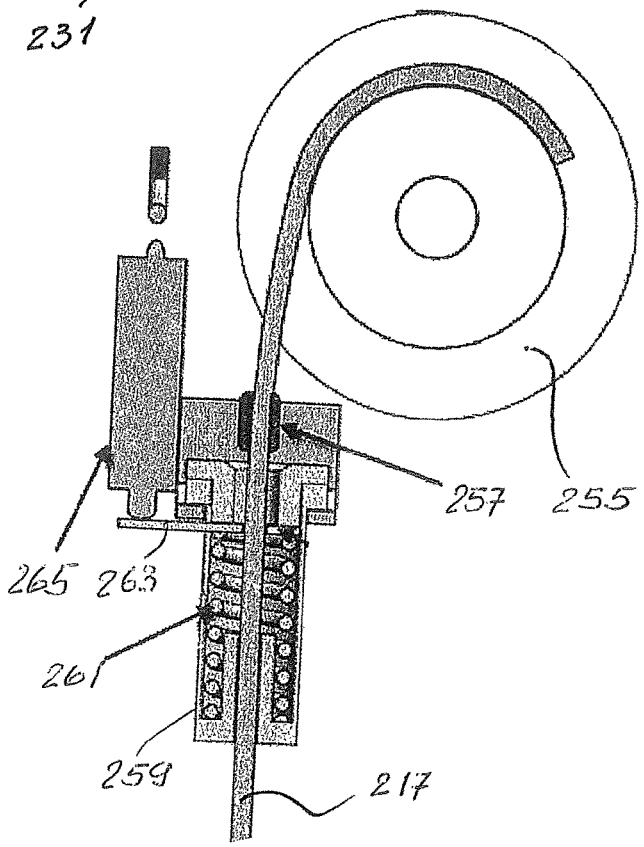
Figure 26:
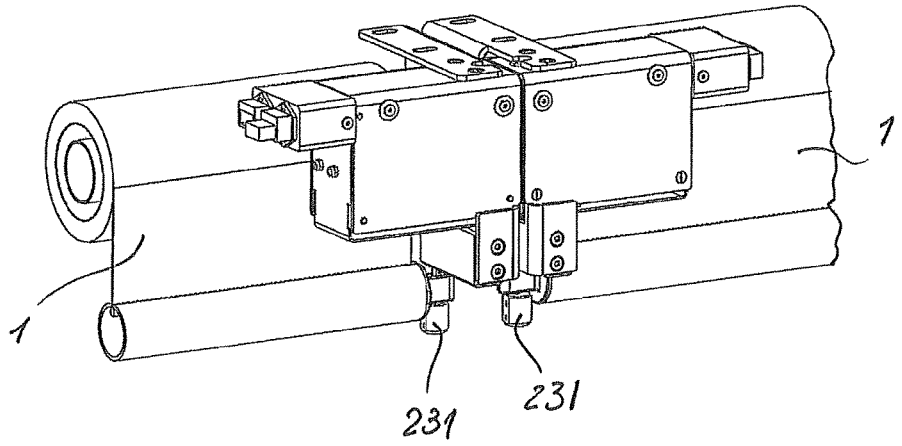
Figure 28:
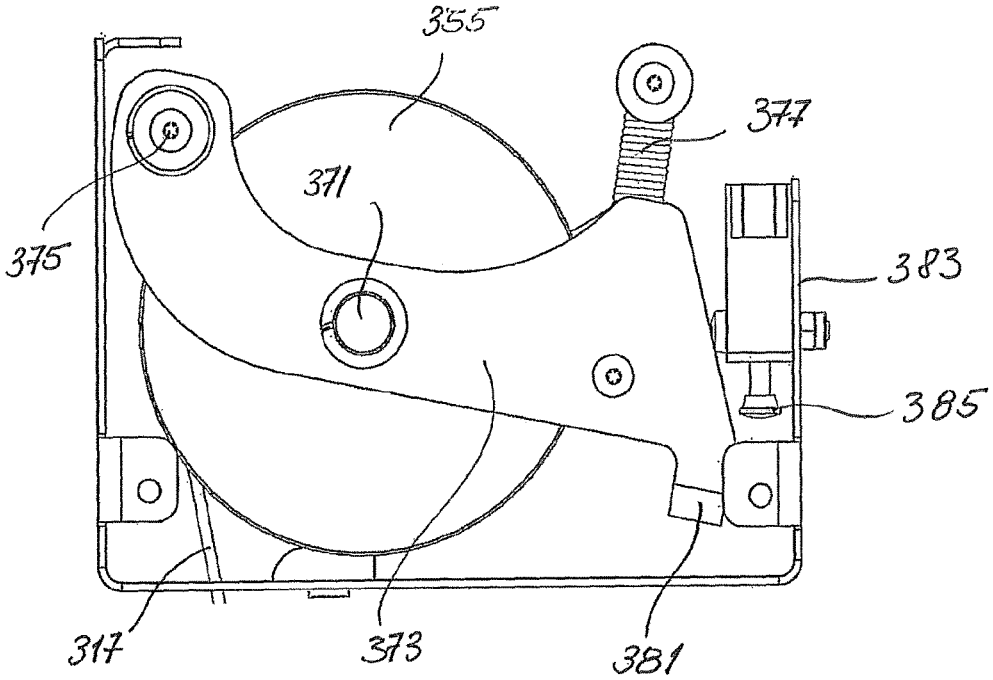
Figure 29:
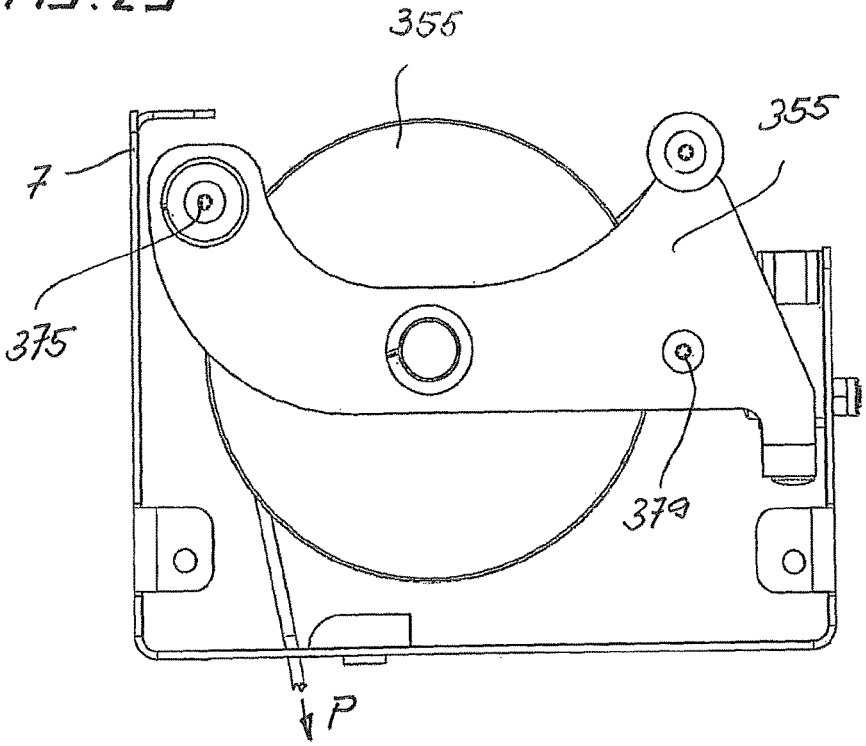

The invention will be explained in more detail with the aid of three illustrated embodiment examples, wherein:

FIG. 1 shows a window or door opening with the hanging pulled up and stored as a slat pack, FIG. 2 shows the door or window opening with the hanging lowered, FIG. 3 shows an enlarged section A in FIG. 2, FIG. 4 shows a cross-section through the strip along line IV-IV in FIG. 3, FIG. 5 shows an enlarged section B in FIG. 6 in a perspective view, FIG. 6 shows a complete perspective view of the lowered hanging, FIG. 7 shows a further embodiment of the invention with a pair of rigid chains hooked into one another with external guide elements, FIG. 8 shows a complete perspective view of the hanging according to FIG. 7, FIG. 9 shows an enlarged section C in FIG. 8, FIG. 10 shows a horizontal section along line IX-IX in FIG. 7, FIG. 11 shows a further embodiment of the invention with a pair of rigid chains with internal guide elements, FIG. 12 shows a complete perspective view of the hanging according to FIG. 11, FIG. 13 shows an enlarged section D in FIG. 12, FIG. 14 shows a section along line XIV-XIV in FIG. 11, FIG. 15 shows a vertical sunblind hanging (lowered) with a temporary rope guide on both sides, FIG. 16 shows the elevating device for the sunblind hanging with the guide ropes lowered, FIG. 17 shows the elevating device for the sunblind hanging with the guide ropes pulled up (coiled up), FIG. 18 shows an enlarged view of section E in FIG. 15, FIG. 19 shows a slat hanging with a temporary rope guide, not completely lowered, FIG. 20 shows a perspective view of the hanging, completely lowered, FIG. 21 shows the hanging with slats pulled up and stacked to form a slat pack, FIG. 22 shows an enlarged view of section F in FIG. 19, FIG. 23 shows a perspective view of the anchoring device for the guide ropes with the lid closed, FIG. 24 shows a perspective view of the anchoring device with the lid open, FIG. 25 shows a vertical section through the winding drum for the guide rope and a clamping chuck as well as a switch in a first embodiment, FIG. 26 shows a perspective view of the elevating device for the guide ropes for a vertical sunblind and FIG. 27 shows a perspective view of the elevating device for the guide ropes for a venetian blind, FIG. 28 shows a lateral view of the winding drum and a rope tension monitoring device, tensed rope, FIG. 29 shows a lateral view of the winding drum and a rope tension monitoring device with loose rope.

In the first embodiment example according to FIGS. 1 to 6 a hanging, for example a venetian blind, with reference numeral 1 is indicated in a front view. A slat pack 5 comprising a plurality of slats 5*a* is suspended from elevating cords 3. The slats 5*a* or the slat pack 5 is/are suspended with its/their elevating cords 3 from an elevating device 7 which is shown by a rectangle in the figures. The elevating elements for winding and unwinding the elevating cords 3, the drive elements as well as the drives for the turning belts 4 are accommodated in the conventional-design elevating device. The box-shaped elevating device 7 is arranged in the ledge (not shown) of a window opening or a door opening 11 in a wall 9.

The elevating device can also be fixed above the window or door opening on the facade. Guide rails 13, in which the slats 5*a* or guide elements or guide pins (not shown) mounted on the ends thereof are guided in a vertical slot, are fixed to the lateral jambs of the opening 11 or externally on the facade. The slats 5*a*, the guide elements or guide pins and the guide rails 13 are known from the state of the art, occurring in many embodiments. The two hangings 1*a* and 1*b* are consequently each guided by the guide rails 13 on one side at the ends of the slats 5*a*. The two adjacent sides of the two hangings 1*a*, 1*b* respectively, which are located in the center of an opening 11, are not guided in fixed guide rails but, according to the invention, in a guide arrangement as shown in sections in the enlarged view A in FIG. 3. This guide arrangement 15 forms a temporary guide which is constructed before or during the lowering of the slats 5*a* and removed again on pulling up the slats 5*a* or thereafter, in order to expose the opening 11 in the wall 9. The guide arrangement 15 comprises two elongated, bendable elements 17 in a first form and rigid elements 17 in a second form. In the first embodiment example according to FIGS. 1 to 6 the elements 17 comprise an elastic metal or plastic strip which is in the form of a section of an arc in cross-section, which is either guided above the elevating device 7 parallel thereto or is rolled up on a core (no fig.). In the extended form, the elements 17 are rigid with respect to their cross-section and can easily be deflected by 90° about a deflection pulley 19. Such deflection pulleys 19 are arranged at the two opposite ends of the elevating devices 7 and guide the elements 19 from the horizontal position into a vertical position.

Alternatively, guide and press rollers 21 can be arranged in front of the deflection pulleys 19, with which the elements 17 which are initially arc-shaped are pressed flat, in order, on being wound around the deflection pulleys 19, to lie in contact with these. Following the deflection by 90° the strip-shaped elements 17 come into contact with each other along their edges 17*a*. This coming into contact is supported by a guide sleeve 23. The elements 17 which then lie in contact with one another with total surface contact with their edges 17*a* penetrate the guide sleeve 23. Arranged below the guide sleeve 23 are glide sliders 25 at which the slats 5*a* are articulated on both sides. Articulated means: the slats 5*a* can be tilted by the turning belts 4 and elevating cords 3 in the conventional manner. The through-opening in the guide sliders 25 are dimensioned such that the guide sliders 25 can slide with little friction, preferably in an approximately frictionless manner, along the two strip-shaped elements 17 which are then combined to form a hollow body.

Of course, the rigid guide rails 13 can also be replaced by flexible temporary elements 17.

The mode of operation of the first embodiment of the invention will be briefly explained below.

Starting from a pulled-up hanging 1, wherein the slats 5*a* lie on top of each other with total surface contact and form a slat pack 5 (cf. black area in FIG. 1), the slat pack 5 is gradually lowered in the known manner by unwinding the elevating cords 3 and the second-top slat 5*a* separates from the slat right at the top until a gap is produced between the two slats, which is determined by the spacing of the fastening elements 27 on the turning belts 4. Synchronously to the lowering movement of the elevating cords 3, the two strip-shaped elements 17 are deflected via the deflection pulleys 19 and brought together with total surface contact in the guide sleeve 23 and thus continuously form a rigid, temporary tubular vertical guide 29.

A conical point 31 or the like is preferably arranged at the lower end of the vertical guide, i.e. at the two ends of the elements 17 which are free but rigidly connected to one another, which can engage in a recess 33 intended for this purpose as an anchoring on the lower edge of the window opening 11 or on the floor, in order to stabilize and fix the vertical guide at the bottom.

The drives for the elevating cords 3 in the two hangings 1*a* and 1*b* and the drives for the two elongated elements 17 are preferably synchronized, if necessary the drives for the elements 17 can run slightly ahead or run more quickly, so that the temporary vertical guide 29 with its point 31 reaches the recess 33, before the hanging 1 is completely extended. Of course, the temporary vertical guide 29 can already be extended completely downwards before the hanging 1 is lowered. This variant ensures that even in unfavorable wind conditions, the hanging 1 can be safely moved vertically downwards.

In the second embodiment example according to FIGS. 7 to 10 two link chains 117, for example push link chains, which are mounted above the elevating device 7, replace strips which are bent in cross-section. In a guide sleeve 123 the link chains 117, after having been deflected downwards in the guide sleeve 123 by means of deflection pulleys (deflection pulleys not shown) and combined, are transformed into a vertical guide 129. Link chains 117, which are hooked to one another in a guide sleeve 123, are known from the prior art as a replacement for elevating devices and will not be described in more detail. A known link chain which is combined with a second link chain to form a rigid element is known by the name of zip chain. To ensure that the link chains 117 are able to guide the ends of the slats 105*a*, guide rail elements 125 are fixed laterally thereto at each of the chain links, said guide rail elements combining following the combination of the two link chains 117 to form a continuous vertical guide 129 for the slats 5*a*. In the slots of the guide rail elements 23, the guide pins are laterally guided at the slats 5*a* and can move freely in the vertical direction.

The mode of operation of the second embodiment example will be explained below. Synchronously with the lowering of the slat pack 5 or running more or less in advance, the link chains 117 are connected together in the guide sleeve 123 and slide vertically downwards as a rigid vertical guide 129. The slats 5*a*, which are guided laterally in the guide rail elements 125 on the chain links 117, also move downwards and take up their spaced position with respect to the vertical.

As in the first embodiment example, a mandrel or the like can also be mounted at the lower end of the combined link chains 117, said mandrel being held centered in a recess in the bottom of the window or door opening.

The third embodiment example according to FIGS. 11 to 14 differs from the second in that the guide rail elements 125 are not laterally fixed to the chain links, but between the individual chain links (cf. FIG. 14).

In order to compensate for the mass of the lowered link chain 117, a spring 137 or a rubber strip can be attached at the upper end thereof, the second end of which is connected to the elevating device 7.

Of course the two adjacent hangings 1, which are guided by the guide arrangement, do not have to be located next to each other in a plane, but they can be arranged at any angle, whether it is an angle of 90° or more or less angular degrees.

A further aesthetically sophisticated design of the invention is shown in two embodiments in FIGS. 15 to 22. Instead of a link chain or other stiffening guide element, a cable or a rope 217 can be provided, which is stored, e.g. rolled up, in the elevating device 7, and which can be lowered together with the hanging 1 or can run in advance of this. An anchoring device, e.g. a magnet 231, is arranged at the lower end of the cable 217 or at the floor and is preferably recessed in the floor, which adheres to the lower boundary 239 of the opening 11 in the wall or to which device the cable is secured, as soon as the cable 217 is lowered.

A first embodiment of a tensioning device 241 is shown in FIG. 23, with which the magnets 231 can be held and tensioned at the lower end of the cables 217 following lowering. In FIG. 23 the tensioning, device 241 is closed by a lid 243 which lies flush with the floor. To allow the lid 243 to be opened, slots 245 are provided therein.

In the open condition according to FIG. 24 it can be seen that extending second slats 249 are formed on the upper cover 247 perpendicular to the slots 245 on the lid 243. Recesses 251 are formed adjacent the two side walls of the tensioning device 241 below the second slots 249, said recesses being intended to insert the cables 217 with the magnets 231 or metal parts attached thereto into the tensioning device 241.

Suitably configured arresting hooks or tongues (not shown) are arranged in the tensioning device 241, which seize the magnets 231 or metal parts and pull the cables 217 downwards and tension them with a tensioning mechanism, of which only a tensioning shaft 253 is visible. Alternatively, the upper cover 247 of the tensioning device 241 can be lowered and pull the magnets 231 resting on the underside thereof downwards.

As an alternative to a tensioning shaft 253 which has to be rotated by hand with an appropriate spanner as a tensioning element, an electrically operated tensioning mechanism can also be used in the tensioning device 241. In a particularly advantageous embodiment of the tensioning device 241 for tensioning the cables 217, a sensor (not shown) can additionally be used which, if there are magnets 231 in the device 241, triggers the tensioning, so that the tensioning command does not have to be given manually.

In another advantageous embodiment of the tensioning device 241 a funnel-shaped opening can be configured in the lid 243 and in the upper cover 247, into which opening the magnet 231 is expediently inserted during lowering of the cable 217, so that the cables 217 are automatically tensioned, as soon as the cables 217 have reached the lower end. The command provides the trigger for the lowering of the cables 217; the blinds or sunblind, i.e. the hanging 1, is lowered.

A winding drum 255 for the cable 217 is shown diagrammatically in FIG. 25. A press sleeve 257 is mounted on the cable 217 which, at the end of the lowering process of the cable 217, runs into a clamping chuck 259 in which a tension spring 261 is accommodated. Located on the upper end of the spring 261 is a switch tongue 263, which is pressed downwards by the press sleeve 257, when the cables 217 are tensioned in the tensioning device 241. Once the tension has been completely built up, the switch tongue 263 disengages from a switch 265. A signal goes from the switch 265 to the control of the hanging 1, so that the hanging 1 can be lowered. The hanging 1 can be raised and lowered as long as the switch tongue 263 is not in contact with the switch 265.

In a further embodiment of the monitoring device according to FIGS. 28 and 29, the shaft of the winding drum 371 for the rope 317 is mounted on a rocker 373 which can be pivoted about a fixed pivot point 375 on the housing of the elevating device 7.

The rocker 373 can either be arranged on one side or on both sides of the winding drum 355. The end of the rocker 373 opposite the pivot point 375 is attached to a tension spring 377, which is permanently attached at the top and acts at the bottom on a bolt 379 on the rocker 373. In the untensioned state, as shown in FIG. 28, a tongue 381 extending horizontally away from the rocker 373 does not touch a switching element 383 or the latter's axially displaceable control button 385. However, as soon as the rope 317 is tensioned in the direction of the arrow P, i.e. when the lower end of the rope 317 is pulled taut in the device 241 in order to tension the rope 317, the rocker 373 is rotated counterclockwise and the tongue 381 is pressed against the control button 385 and pushes this upwards in the switching element 383. Once this has been done, the controller (not shown) recognizes that the vertical guide for the hanging (blind or sunblind) is ready to lower the hanging and to guide it laterally in the lowered position.

Once the hanging has been raised again by the operator and the window or door opening is no longer covered by a hanging, the rope can be released again from the device 241 for tensioning the rope 317 and is rolled back up onto the winding drum 355 by a spring installed in the winding drum 355. A brake element (not shown) in the winding drum 355 causes the rope 317 to pull up slowly and the latter's lower end cannot be tossed around uncontrollably with the magnetic or metallic holding element.

FIGS. 26 and 27 show the housing of the winding drum 255 and its arrangement laterally or above the elevating device 7. FIG. 26, which shows the elevating device for a vertical sunblind, clearly shows how the cables 217 are guided by end pieces 267 on an end rail 269 on the hanging 1.

In FIG. 27, the cables 217 preferably run into suitably mounted openings 271 in the edge areas of the slats of the slat pack 5. Therefore, no additional guide pins or the like projecting beyond the ends of the slats, as are usually found in the case of guiding in lateral rigid guide rails, are necessary.

The downwards movement, i.e. the unwinding of the cables 217, is carried out in the basic embodiment by pulling down the cables 217 at the magnets 231 or magnetizable metal elements, for example with a magnet arranged at the end of a bar (no figure). Of course, it is also possible for the winding drum 255 to be driven electrically, i.e. for the cable 217 to be unwound without manual interventions and, if a funnel-shaped inlet is provided in the tensioning device 241, to allow the cable to run in there and have it tensioned by the tensioning device.

In a further embodiment, which is not shown, the vertical guide for the slats 5*a* is formed by a plurality of pipe sections lined up on a rope. The pipe sections can, if the rope is not tensioned, be guided vertically like the chain links in the second embodiment example about a deflection pulley, and by tensioning of the rope following transfer into the vertical position the pipe sections are pressed together such that they form the stiffened guide for the slats 5*a*.

In a further embodiment of the invention, which is not shown, the vertical guide is formed by a telescopic tube which enters the light of the door or window opening from above and on which guides are arranged which guide the ends of the slats 5*a* of the adjacent hangings 1 (no figure).

The invention claimed is:

1. A sun-shade system, comprising:

a sun-shade operable between a storage configuration and a shading configuration;

a guide operable between a retracted configuration and an extended configuration; and an anchoring system that releasably anchors an end portion of said guide in said extended configuration, wherein said anchoring system comprises a lid and is configurable in at least an open lid configuration and a closed lid configuration, and said anchoring system is installable in a surface such that, in said closed lid configuration, a major surface of said lid is substantially coplanar with said surface.

2. The sun-shade system of claim 1, wherein:

said guide, in said extended configuration, guides said sun-shade between said storage configuration and said shading configuration, and in said retracted configuration, an entirety of said guide is proximate to said sun-shade in said storage configuration.

3. The sun-shade system of claim 1, wherein:

said guide has substantially the shape of a cord.

4. The sun-shade system of claim 1, comprising:

a control system that inhibits operation of said sun-shade from said storage configuration to said shading configuration when said guide is not in said extended configuration.

5. The sun-shade system of claim 1, comprising:

a braked drum that brakes a retraction of said guide from said extended configuration to said retracted configuration.

6. The sun-shade system of claim 1, wherein:

said anchoring device comprises an electrically operated tensioning device that tensions said guide in a longitudinal direction of said guide.

7. The sun-shade system of claim 6, comprising:

a sensor, wherein an actuation of said tensioning device is automatically effected in response to an output of said sensor.

8. The sun-shade system of claim 1, wherein:

said anchoring system comprises a first slot, said lid comprises a second slot substantially orthogonal to said first slot when said lid is in said closed lid configuration, and each of said first slot and said second slot has at least one open end.

9. The sun-shade system of claim 8, wherein:

said guide extends along a straight line through said first slot and said second slot in said extended configuration.

10. The sun-shade system of claim 1, wherein:

said anchoring system, in at least said open lid configuration, effects said releasable anchoring independently of said lid.

11. The sun-shade system of claim 1, wherein:

said lid, in said closed lid configuration, forms at least part of a closed lid configuration substantially planar surface of said anchoring system, and in a plane defined by said closed lid configuration substantially planar surface, a perimeter of said lid does not extend substantially beyond a perimeter of said closed lid configuration substantially planar surface in a motion of said lid from said open lid configuration to said closed lid configuration.

12. The sun-shade system of claim 1, wherein:

said end portion of said guide comprises a magnet.

13. The sun-shade system of claim 1, wherein:

said anchoring system comprises a housing, said lid being pivotably mounted to said housing.

14. A sun-shade guide cord anchoring system, comprising:

a first slot; and a lid comprising a second slot substantially orthogonal to said first slot, wherein each of said first slot and said second slot has at least one open end, said anchoring system is configurable in at least an open lid configuration and a closed lid configuration, in said closed lid configuration, a portion of said first slot and a portion of said second slot align along an axis substantially orthogonal to a major face of said lid, and said anchoring system is installable in a surface such that, in said closed lid configuration, said major face of said lid is substantially coplanar with said surface.

15. The anchoring system of claim 14, comprising:

said anchoring device comprises an electrically operated tensioning device capable of tensioning a guide cord in a direction substantially parallel to said axis.

16. The anchoring system of claim 14, comprising:

a housing having an opening, wherein said first slot is situated in said housing, and said lid is pivotably mounted to said housing, said lid substantially covering said opening in said closed lid configuration.

17. The anchoring system of claim 14, comprising:

a third slot, wherein said lid comprises a fourth slot substantially orthogonal to said third slot, in said closed lid configuration, a portion of said third slot and a portion of said fourth slot align along an axis substantially orthogonal to said major face of said lid, and each of said third slot and said fourth slot has at least one open end.

18. The anchoring system of claim 14, wherein:

said lid, in said closed lid configuration, forms at least part of a closed lid configuration substantially planar surface of said anchoring system, and in a plane defined by said closed lid configuration substantially planar surface, a perimeter of said lid does not extend substantially beyond a perimeter of said closed lid configuration substantially planar surface in a motion of said lid from said open lid configuration to said closed lid configuration.

19. A method of installing a sun-shade system, comprising:

mounting at least one sub-system of said sun-shade system above a floor, said at least one sub-system comprising a sun-shade operable between a storage configuration and a shading configuration and a guide operable between a retracted configuration and an extended configuration; and providing, in said floor, an anchoring system that releasably anchors an end portion of said guide in said extended configuration, wherein said anchoring system comprises a lid and is configurable in at least an open lid configuration and a closed lid configuration, and a major surface of said lid, in said closed lid configuration, is substantially coplanar with said floor.

* * * * *